US008702185B2

(12) United States Patent
Chellappan et al.

(10) Patent No.: US 8,702,185 B2
(45) **Date of Patent: *Apr. 22, 2014**

(54) REFRIGERATOR APPLIANCE WITH A DRAWER

(75) Inventors: Bagawathkumar Chellappan, Louisville, KY (US); Scott Gabriel Brown, Louisville, KY (US); Gopi Krishna Chowdary Vulava, Okemos, MI (US); Sundaramoorthy Venkatraj, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/466,197

(22) Filed: May 8, 2012

(65) Prior Publication Data

US 2013/0300275 A1 Nov. 14, 2013

(51) Int. Cl.
*A47B 96/04* (2006.01)

(52) U.S. Cl.
USPC ..... 312/402

(58) Field of Classification Search
USPC ..... 312/402, 404, 334.14, 334.15, 334.9, 312/334.11, 334.13, 334.7, 334.6, 334.27, 312/334.32, 334.33, 331
See application file for complete search history.

(56) References Cited

U.S. PATENT DOCUMENTS

| | | | | |
|---|---|---|---|---|
| 2,468,990 | A * | 5/1949 | Lundstrom | 312/334.33 |
| 2,613,123 | A * | 10/1952 | Patten | 312/402 |
| 4,285,560 | A * | 8/1981 | Miller | 312/331 |
| 4,324,439 | A | 4/1982 | Hagen et al. | |
| 5,322,365 | A * | 6/1994 | Teufel et al. | 312/330.1 |
| 5,944,400 | A | 8/1999 | Fulterer | |
| 6,039,423 | A | 3/2000 | Fulterer | |
| 6,231,138 | B1 * | 5/2001 | Janson | 312/201 |
| 6,338,316 | B1 * | 1/2002 | Weaver | 119/453 |
| 6,367,651 | B2 * | 4/2002 | Laib et al. | 220/676 |
| 6,412,892 | B1 | 7/2002 | Bonat | |
| 6,499,818 | B2 | 12/2002 | Brustle | |
| 6,682,159 | B2 | 1/2004 | Compagnucci | |
| 7,306,301 | B2 | 12/2007 | Walburn | |
| 7,628,461 | B2 * | 12/2009 | Carden et al. | 312/402 |
| 7,677,125 | B2 | 3/2010 | Rotter | |
| RE41,725 | E | 9/2010 | Walburn | |
| 7,810,890 | B2 * | 10/2010 | Klein et al. | 312/334.33 |
| 2009/0193836 | A1 * | 8/2009 | Ertz et al. | 62/449 |
| 2009/0261698 | A1 * | 10/2009 | Cabal Velarde et al. | 312/334.8 |
| 2010/0019641 | A1 * | 1/2010 | Laible et al. | 312/404 |
| 2011/0018415 | A1 | 1/2011 | Kim et al. | |
| 2012/0262044 | A1 * | 10/2012 | Vulava | 312/404 |

FOREIGN PATENT DOCUMENTS

| | | |
|---|---|---|
| GB | 1 235 094 | 6/1971 |
| JP | 9324980 A | 12/1997 |

* cited by examiner

*Primary Examiner* — Darnell Jayne
*Assistant Examiner* — Timothy M Ayres
(74) *Attorney, Agent, or Firm* — Dority & Manning, P.A.

(57) ABSTRACT

A refrigerator appliance is provided. The refrigerator appliance includes a drawer received within a chilled chamber. The drawer is mounted within the chilled chamber using drawer slides. The drawer slides are positioned at a bottom of the chilled chamber and support a bottom portion of a basket mounted on the drawer. Such a configuration can increase actual and/or perceived storage space within the chilled chamber and provide other improvements.

20 Claims, 5 Drawing Sheets

REFRIGERATOR APPLIANCE WITH A DRAWER

FIELD OF THE INVENTION

The present subject matter relates generally to refrigerator appliances with drawers mounted within a chilled chamber of the appliance.

BACKGROUND OF THE INVENTION

Refrigerator appliances can include a cabinet that defines a fresh food chamber for receipt of fresh food items and a freezer chamber for receipt of frozen food items. In certain refrigerator appliances, the freezer chamber can be disposed below the fresh food chamber. Such refrigerator appliances are generally referred to as bottom-mount refrigerator appliances.

Certain bottom-mount refrigerator appliances include a drawer received within the freezer chamber to which the freezer door is mounted. The drawer can support a basket such that the basket is disposed within the freezer chamber when the drawer is closed and is disposed outside of the freezer chamber when the drawer is open. Drawer slides can be used to mount the drawer to the appliance's cabinet. Certain baskets include a lip or flange at a top of the basket. The flange rests on the drawer slides or related brackets in order to hang the basket from the drawer slides. In such appliances, the drawer slides are mounted to the freezer chamber's walls such that the basket can hang from the drawer slides.

Such a configuration has certain drawbacks. For example, the basket's flange can experience significant deflection when basket is loaded with heavy items. Also, perceived and actual storage volume within the basket and freezer chamber can be reduced by location of the drawer slides. Also, the bottom of the basket can snag on the drawer slides during removal of the basket from the freezer chamber. Accordingly, a refrigerator appliance with improved features for mounting a basket within a chilled chamber of the appliance would be useful. Also, a refrigerator appliance with features for mounting a drawer within a chilled chamber of the appliance such that the actual and/or perceived storage space of the chilled chamber is increased would be useful.

In addition, a bottom panel of the basket can deflect when loaded with heavy items. To reduce such deflection, the basket can include ribs and/or metal stiffeners to reduce the deflection. However, stiffeners offer limited support and can add to the overall cost of producing the refrigerator appliance. Accordingly, a basket for a refrigerator appliance with features for supporting a bottom panel of the basket would be useful.

Also, as the drawer shifts open and closed, the drawer slides can rack when they do not open and close simultaneously. Such racking can damage the drawer slides and/or the drawer. To limit racking, the drawer slides can be connected using a rack and pinion system that compels the drawer slides to shift simultaneously. However, such rack and pinion systems can be complex and expensive. Accordingly, a refrigerator appliance with features for limiting racking of the drawer would be useful. In particular, a refrigerator appliance with features for limiting racking of the drawer without a rack and pinion system would be useful.

BRIEF DESCRIPTION OF THE INVENTION

The present invention provides a refrigerator appliance that includes a drawer received within a chilled chamber. The drawer is mounted within the chilled chamber using drawer slides. The drawer slides are positioned at a bottom of the chilled chamber and support a bottom portion of a basket mounted on the drawer. Such a configuration can increase actual and/or perceived storage space within the chilled chamber and provide other improvements over conventional configurations. Additional aspects and advantages of the invention will be set forth in part in the following description, or may be apparent from the description, or may be learned through practice of the invention.

In a first exemplary embodiment, a bottom-mount refrigerator appliance is provided. The refrigerator appliance includes a cabinet that defines an upper fresh food chamber and a lower freezer chamber for receipt of food items. The lower freezer chamber includes a top wall, a bottom wall spaced apart from said top wall along a vertical direction, and a first side wall and a second side wall extending between said top and bottom walls along the vertical direction. The first and second side walls are spaced apart along a horizontal direction. A basket is received within the lower freezer chamber of the cabinet. The basket extends between a top portion and a bottom portion along the vertical direction. A freezer drawer is slidingly mounted within the lower freezer chamber and configured for permitting selective access to the lower freezer chamber of the cabinet. The drawer includes a freezer door, a first drawer slide, and a second drawer slide. The first and second drawer slides mount the door to the cabinet and support the basket at the bottom portion of the basket. The first drawer slide is secured to the first side wall at a bottom of the lower freezer chamber. The second drawer slide is secured to the second side wall at the bottom of the lower freezer chamber.

In a second exemplary embodiment, a refrigerator appliance is provided. The refrigerator appliance includes a cabinet that defines a chilled chamber for receipt of food items. The chilled chamber includes a top wall, a bottom wall spaced apart from said top wall along a vertical direction, and a first side wall and a second side wall extending between said top and bottom walls along the vertical direction. The first and second side walls are spaced apart along a horizontal direction. A basket is received within the chilled chamber of the cabinet. The basket extends between a top portion and a bottom portion along the vertical direction. A drawer is slidingly mounted within the chilled chamber and configured for permitting selective access to the chilled chamber of the cabinet. The drawer includes a door, a first drawer slide, and a second drawer slide. The first and second drawer slides mount the door to the cabinet and support the basket at the bottom portion of the basket. The first drawer slide is positioned on a first side the chilled chamber. The second drawer slide is positioned on a second side the chilled chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
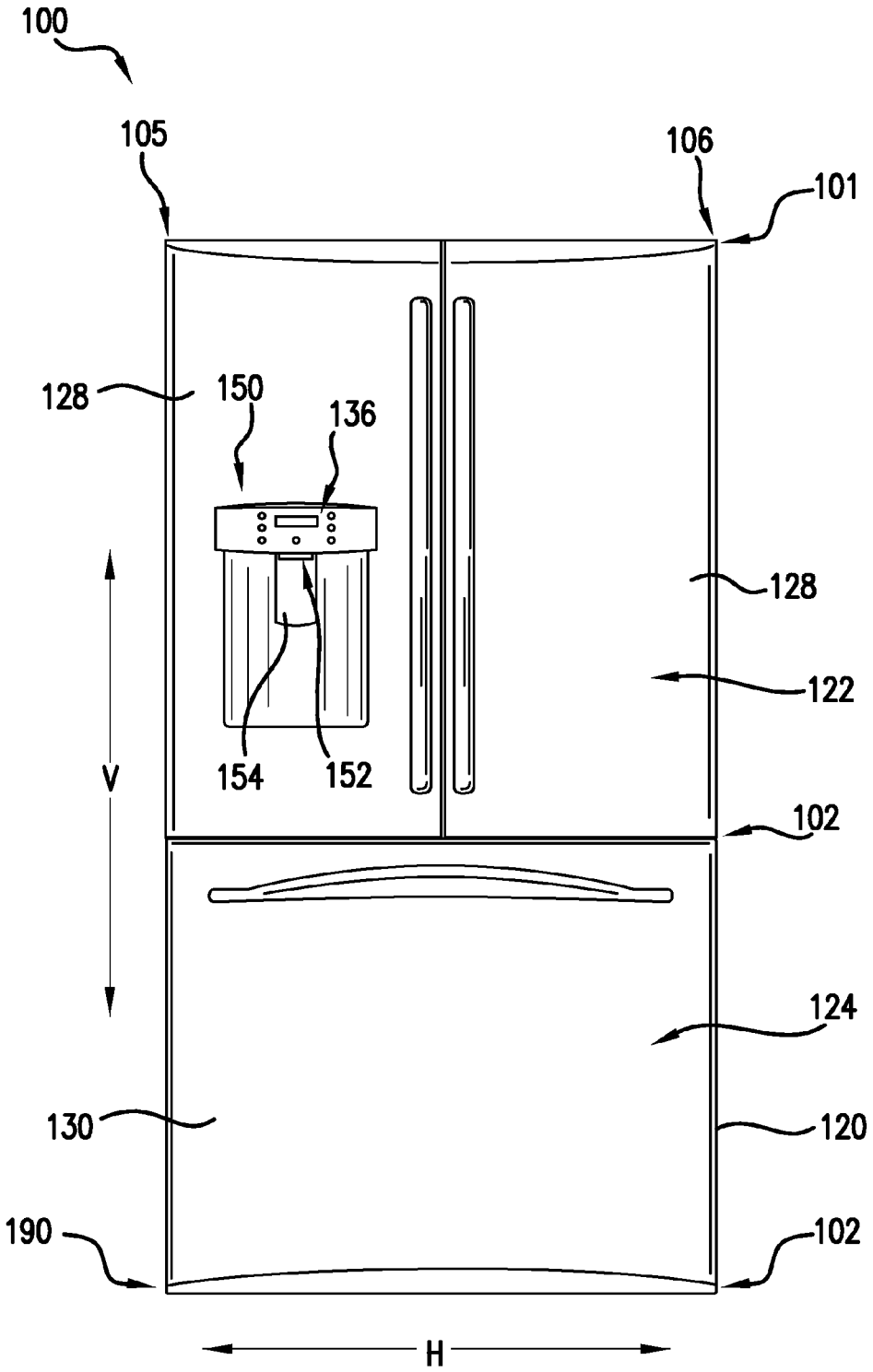
FIG. 1 provides a front view of a refrigerator appliance according to an exemplary embodiment of the present subject matter and, in particular, a freezer drawer of the refrigerator appliance is shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
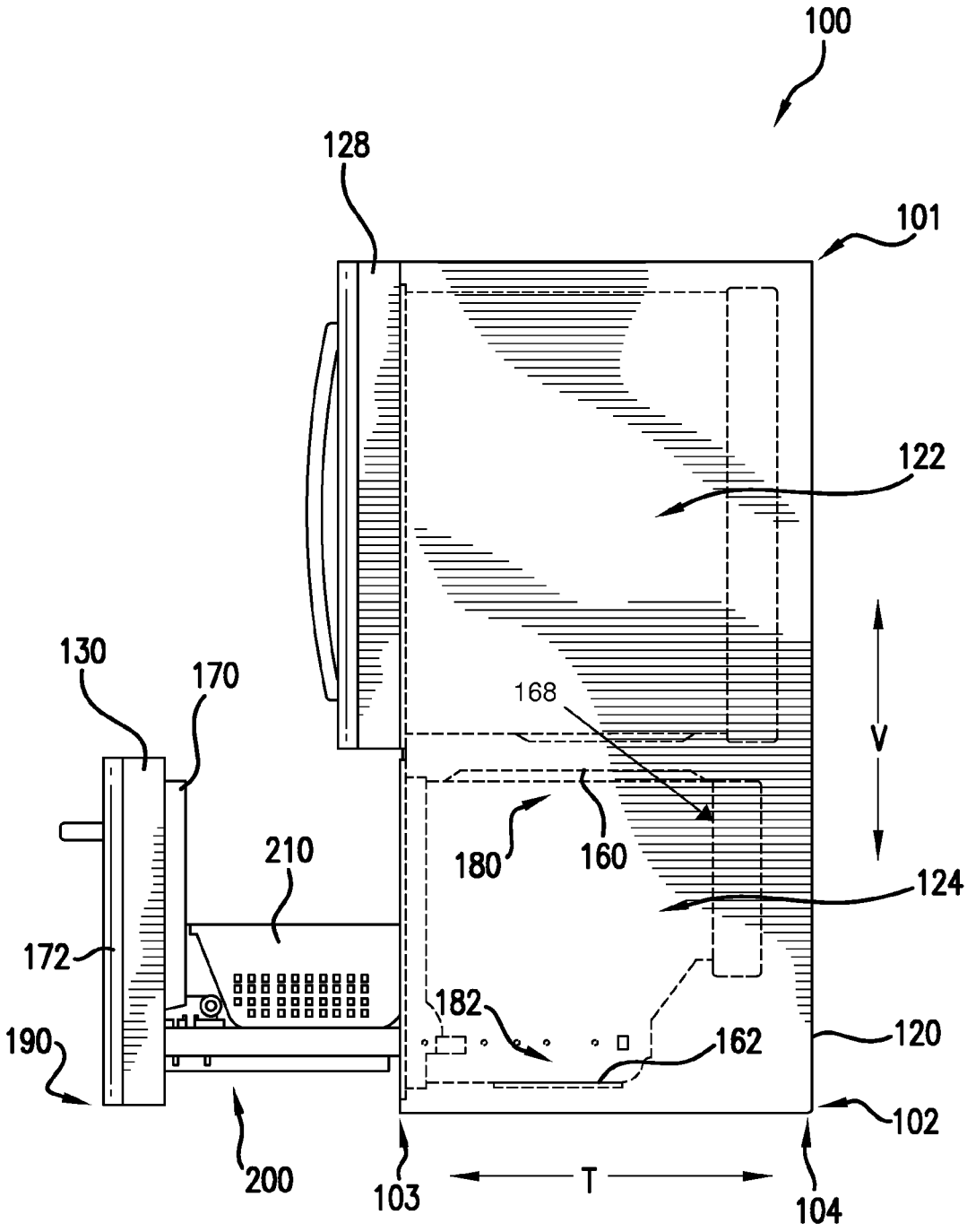
FIG. 2 provides a side view of the refrigerator appliance of FIG. 1 with the exemplary freezer drawer shown in an open position.

FIG. 1 is a front view of a refrigerator appliance 100 according to an exemplary embodiment of the present subject matter. Refrigerator 100 includes a housing or cabinet 120 defining chilled chambers for receipt of food items. In FIG. 1, cabinet 120 defines an upper fresh food chamber 122 and a lower freezer chamber 124. As such, refrigerator 100 is generally referred to as a bottom mount refrigerator. It is recognized, however, that the benefits of the present invention apply to other types of refrigerators, e.g., side-by-side style refrigerators. Consequently, the embodiment of refrigerator appliance 100 shown in FIGS. 1 and 2 is shown for illustrative purposes only and is not intended to limit the invention in any aspect.

Refrigerator doors 128 are rotatably hinged to an edge of cabinet 120 for accessing fresh food chamber 122. A freezer door 130 is arranged below refrigerator doors 128 for accessing freezer chamber 124. Freezer door 130 is coupled to a freezer drawer 200 (FIG. 2) slidably mounted within freezer chamber 124.

Refrigerator appliance 100 extends between a top 101 and a bottom 102 along a vertical direction V and also extend between a first side 105 and a second side 106 along a horizontal direction H. As may be seen in FIG. 2, refrigerator appliance 100 also extends between a front 103 and a back 104 along a transverse direction T. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

A dispenser 150 is mounted within one of refrigerator doors 128. Dispenser 150 includes a discharging outlet 152 for accessing ice and water. A paddle 154 is mounted below discharging outlet 152 for operating dispenser 150. A control panel 136 is provided for controlling the mode of operation. For example, control panel 136 includes a water dispensing button (not labeled) and an ice-dispensing button (not labeled) for selecting a desired mode of operation.

Discharging outlet 152 and paddle 154 are an external part of dispenser 150. Dispenser 150 is positioned at a predetermined elevation convenient for a user to access ice or water enabling the user to access ice without the need to bend-over, and without the need to access freezer chamber 124. In the exemplary embodiment, dispenser 150 is positioned at a level that approximates the chest level of a user.

FIG. 2 provides a side view of refrigerator appliance 100 with freezer drawer 200 shown in an open position and without basket 210 in position. In the open position, freezer drawer 200 may be partially or fully disposed outside of freezer chamber 124. Conversely, freezer drawer 200 can be disposed within freezer chamber 124 in a closed position (shown in FIG. 1). A user can selectively adjust freezer drawer 200 between the open and closed positions. For example, when freezer drawer 200 is in the closed position as shown in FIG. 1, the user can pull on freezer door 130 in the transverse direction T away from cabinet 120 in order to slide freezer drawer 200 out of freezer chamber 124 to the open position shown in FIG. 2.

Freezer door 130 is mounted to freezer drawer 200. When freezer drawer 200 is in the closed position, freezer door 130 impedes access to freezer chamber 124. Conversely, when freezer drawer 200 is in the open position, freezer door 130 permits access to freezer chamber 124. Thus, freezer drawer 200 is also configured for selectively adjusting the position of freezer door 130 in order to permit selective access to freezer chamber 124.

Freezer door 130 has an interior panel 170 spaced apart from an exterior panel 172 along the transverse direction T. A cavity (not shown) is defined between interior and exterior panels 170, 172. The cavity is filled within insulation, e.g., in order to assist in limiting heat transfer between freezer chamber 124 and an exterior atmosphere when freezer drawer 200 is in the closed position.

A basket 210 is disposed on freezer drawer 200 and configured for receipt of food items. Such food items can be placed within a storage volume 211 (FIG. 4) defined by basket 210. In the exemplary embodiment shown FIG. 2, basket 210 is sized such that basket 210 fills only a portion of freezer chamber 124 (e.g., about half). However, basket 210 may have any suitable sizing and shape. For example, basket 210 can fill substantially all of freezer chamber 124.

Basket 210 is removably disposed on freezer drawer 200. Thus, a user can lift basket 210 off freezer drawer 200, e.g., in order to clean basket 210. In alternative exemplary embodiments, basket 210 can be fixed or coupled to freezer drawer 200. Also, in FIG. 2, a single basket 210 is mounted to freezer drawer 200. However, freezer drawer 200 may support any suitable number of baskets, e.g., two, three, or more.

Figure 3:
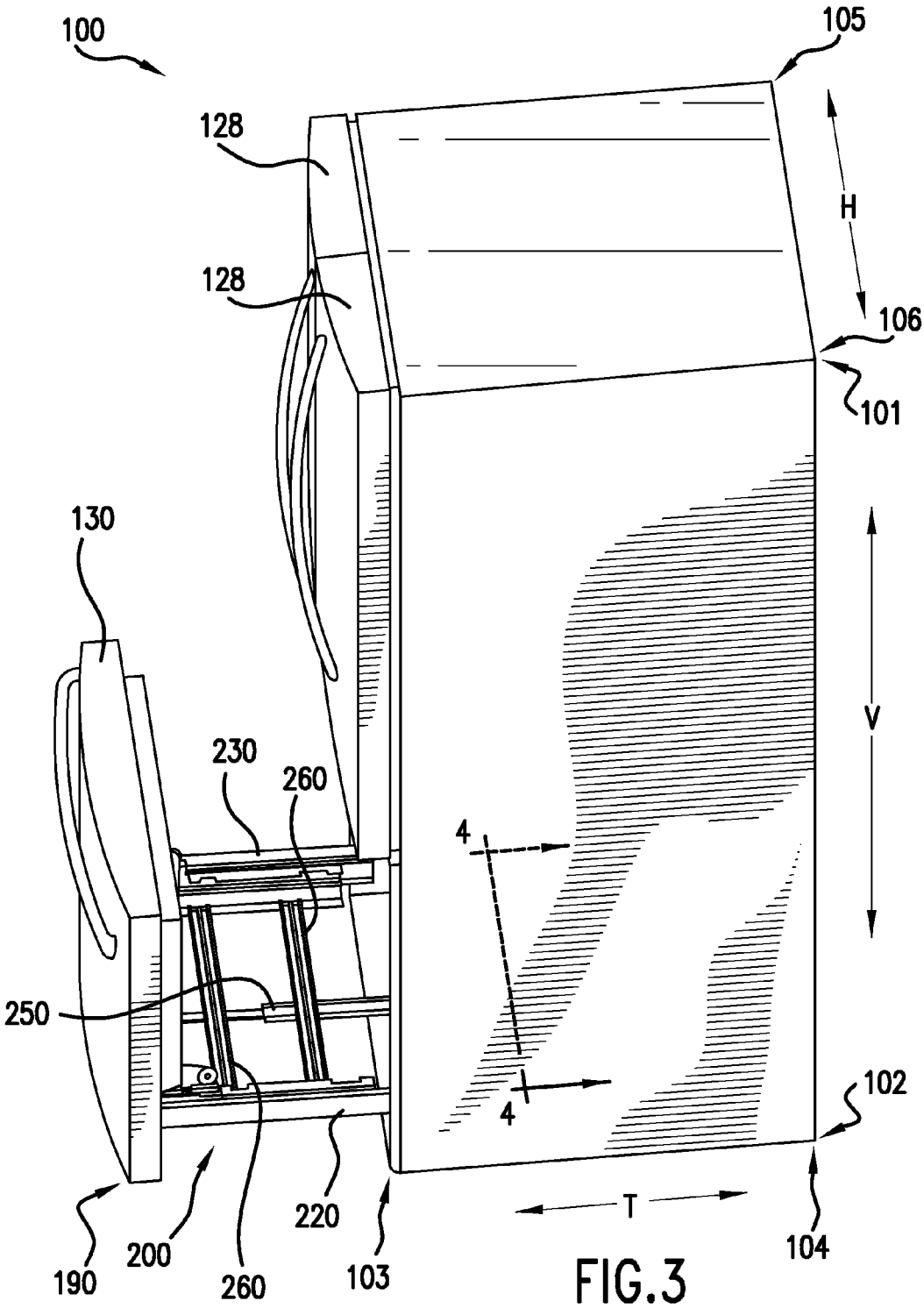
FIG. 3 provides a top view of the refrigerator appliance of FIG. 2 with a basket removed from the exemplary freezer drawer.

FIG. 3 provides a top view of refrigerator appliance 100 with basket 210 (FIG. 2) removed from freezer drawer 200. Freezer drawer 200 includes a first drawer slide or set of slide rails 220 and a second drawer slide or set of slide rails 230. First and second sets of slide rails 220 and 230 are configured for supporting basket 210. First and second sets of slide rails 220 and 230 extend between cabinet 120 and freezer door 130 in order to mount freezer door 130 to cabinet 120. As may be seen in FIG. 2, first and second sets of slide rails 220 and 230 connect to freezer door 130, e.g., at a bottom 190 of freezer door 130.

Freezer drawer 200 also includes a third drawer slide or set of slide rails 250 disposed between first set of slide rails 220 and second set of slide rails 230. Third set of slide rails 250 is configured hindering racking of freezer drawer 200. It should be understood that freezer drawer 200 need not include third set of slide rails 250. Thus, first and second sets of slide rails 220, 230 can be sufficient to support basket 210. Also, freezer drawer 200 may include a rack and pinion system (not shown) that is well known in the art for hindering racking of freezer drawer 200, e.g., rather than third set of slide rails 250. Other suitable configurations are available as well, e.g., third set of slide rails 250 and a rack and pinion system may be employed simultaneously.

As will be understood by those skilled in the art using the teachings disclosed herein, first, second, and third sets of slide rails 220, 230, and 250 are configured for adjusting between an extended configuration (shown in FIG. 3) and a retracted configuration (shown in FIG. 1). Thus, first, second, and third sets of slide rails 220, 230, and 250 assist freezer drawer 200 in selectively sliding between the open and closed configurations discussed above.

Connection members or cross-members 260 extend between and connect first set of slide rails 220 and second set of slide rails 230. Cross-members 260 may also extend between and connect third set of slide rails 250 to first and second sets of slide rails 220, 230. Cross-members 260 are configured for hindering racking of freezer drawer 200. For example, by extending between and connecting first, second, and third sets of slide rails 220, 230, and 250, cross-members 260 couple first, second, and third sets of slide rails 220, 230, and 250 together such that the sets of slide rails 220, 230, and 250 travel at a common linear displacement rate. For example, when a user pulls on freezer door 130, first, second, and third sets of slide rails 220, 230, and 250 slide freezer drawer 200 out of freezer chamber 124 at the same rate due to cross-members 260. Cross-members 260 can also assist in supporting basket 210 (FIG. 2). For example, basket 210 can be disposed on top of cross-members 260.

Figure 4:
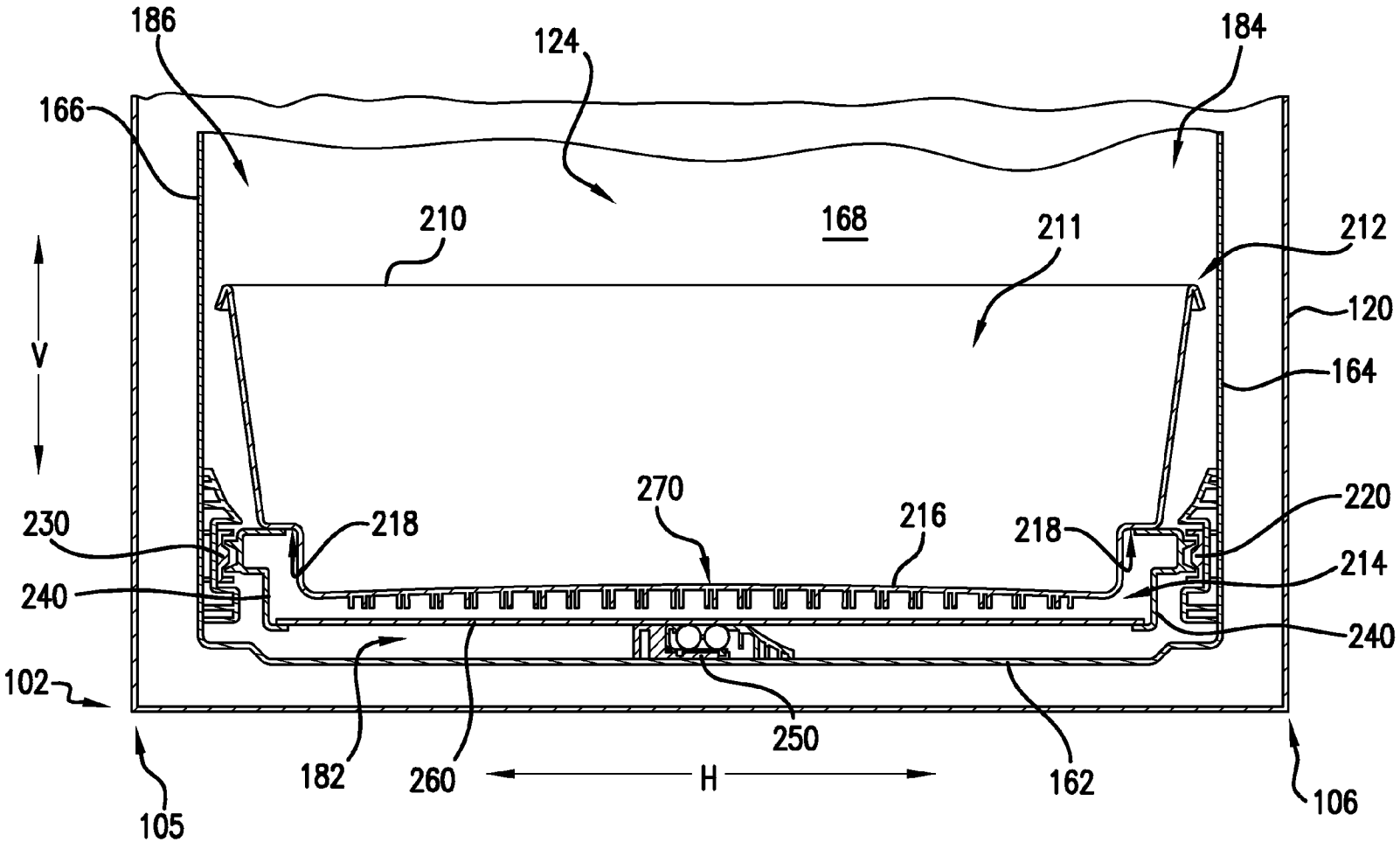
FIG. 4 provides a front, partial cross-sectional view of the refrigerator appliance of FIG. 1 taken along the 4-4 line shown in FIG. 3.

FIG. 4 provides a front, partial cross-sectional view of refrigerator appliance 100 of FIG. 1 taken along the 4-4 line shown in FIG. 3. As may be seen in FIG. 2, freezer chamber 124 extends between a top portion 180 and a bottom portion 182 along the vertical direction V. Turning back to FIG. 4, freezer chamber 124 also extends between a first side 184 and a second side 186 along the horizontal direction H.

Freezer chamber 124 includes a top wall 160 (FIG. 2), a bottom wall 162, a first sidewall 164, a second sidewall 166, and a back wall 168. Top wall 160 is positioned in top portion 180 (FIG. 2) of freezer chamber 124. Top wall 160 is also spaced apart from bottom wall 162 along the vertical direction V. Bottom wall 162 is positioned in bottom portion 182 of freezer chamber 124. First and second side walls 164, 166 extend between and connect top wall 160 and bottom wall 162 along the vertical direction V. First and second sidewalls 164, 166 are spaced apart along the horizontal direction H. Back wall 168 extends between and connects first and second sidewalls 164, 166 along the horizontal direction H. Back wall 168 also extends between and connects top wall 160 and bottom wall 162 along the vertical direction V. Back wall 168 is spaced apart from freezer door 130 (FIG. 2) along the transverse direction T.

First set of slide rails 220 is positioned on first side wall 164. Thus, first set of slide rails 220 is disposed adjacent (e.g., at) first side 184 of freezer chamber 124. Second set of slide rails 230 is positioned on second side wall 166. Thus, second set of slide rails 230 is disposed adjacent (e.g., at) second side 186 of freezer chamber 124. First and second side walls 164, 166 may be constructed of a plastic, sheet metal, or any other material. First and second sets of slide rails 220 and 230 may be secured to cabinet 120 (e.g., framing of cabinet 120) in order to securely mount first and second sets of slide rails 220 and 230 within freezer chamber. For example, fasteners (not shown) may extend through first and second sets of slide rails 220 and 230 into cabinet 120 in order to mount first and second sets of slide rails 220 and 230 on first and second sidewalls 164 and 166 respectively. Third set of slide rails 250 may be similarly mounted.

First and second sets of slide rails 220 and 230 are also positioned adjacent (e.g., in or at) bottom portion 182 of freezer chamber 124. Thus, as shown in FIG. 4, a bottom portion 214 of basket 210 is supported by first and second sets of slide rails 220 and 230 when basket 210 is disposed on freezer drawer 200. As an example, first and second sets of slide rails 220 and 230 may be disposed at or below a center of gravity of basket 210 on the vertical direction V when basket 210 is mounted on freezer drawer 200.

First and second sets of slide rails 220 and 230 both include a bracket 240 that supports a flange 218 of basket 210. The flange 218 is disposed at the bottom portion 214 of basket 210. Flange 218 is spaced apart from and substantially parallel to a bottom plate 216 of basket 210. Flange 218 rests on bracket 240 in order to assist first and second sets of slide rails 220 and 230 in supporting basket 210.

By positioning first and second sets of slide rails 220 and 230 adjacent bottom portion 182 of freezer chamber 124 such that first and second sets of slide rails 220 and 230 are positioned at bottom portion 214 of basket, storage volume 211 of basket 210 can be increased. For example, if sets of slide rails 220 and 230 were positioned at top 212 of basket 210, basket 210 could be unable to fully extend between first and second sides 184 and 186 of freezer chamber 124. Also, positioning first and second sets of slide rails 220 and 230 adjacent bottom portion 182 of freezer chamber 124 can increase a perceived storage capacity of freezer chamber 124 to a consumer. Also, air flow around basket 210 can be improved by positioning first and second sets of slide rails 220 and 230 adjacent bottom portion 182 of freezer chamber 124.

Further, positioning first and second sets of slide rails 220 and 230 adjacent bottom portion 182 of freezer chamber 124 can provide a more reliable seal between freezer door 130 and cabinet 120. For example, due to certain design and construction constrains, cabinet 102 can have greater dimensional consistency at a bottom of cabinet 120. Thus, by mounting first and second sets of slide rails 220 and 230 at such a location, uniformity of the seal between freezer door 130 and cabinet 120 can be improved.

First and second sets of slide rails 220 and 230 are vertically oriented to hinder freezer drawer 200 from deflecting in the vertical direction V, e.g., when freezer drawer 200 is in the open position (shown in FIG. 2). Conversely, third set of slide rails 250 is horizontally oriented to hinder freezer drawer 200 from deflecting in the horizontal direction H, e.g., as freezer drawer shifts between the open and closed positions. By orienting third set of slide rails 250 horizontally, third set of slide rails 250 can hinder racking of freezer drawer. Because first and second sets of slide rails 220 and 230 hinder vertical deflection of freezer drawer 200 and third set of slide rails 250 hinders horizontal deflection of freezer drawer 200, freezer drawer 200 can be limited to sliding along the transverse direction T (FIG. 2) during opening and closing of freezer drawer 200.

In FIG. 4, third set of slide rails 250 is disposed between first side 184 and second side 186 of freezer chamber 124 on the horizontal direction H and below basket 210 on the vertical direction V. In particular, third set of slide rails 250 is positioned equidistant from first side 184 and second side 186 of freezer chamber 124 such that the third set of slide rails 250 is disposed at a center of freezer chamber 124 along the horizontal direction H. However, it should be understood that third set of slide rails 250 may be positioned at any suitable location on bottom wall 162 and need not be located at the center.

In addition, as may be seen in FIG. 4, bottom plate 216 of basket 210 is arcuate along the horizontal direction H. In particular, bottom plate 216 is crowned along the horizontal direction H. Thus, bottom plate 216 has a peak 270 that corresponds to a portion of bottom plate 216 that is disposed furthest from bottom wall 162 of freezer chamber 124 when basket 210 is mounted to freezer drawer 200. The crowned shape of bottom plate 216 can assist basket 210 is supporting items in storage volume 211. For example, storage volume 211 of basket 210 can contain heavy items. Such items can rest on bottom plate 216. By crowning bottom plate 216, deflection of bottom plate 216 along the vertical direction V due to items contained within storage volume 211 can be reduced. Thus, storage basket 210 can have improved reliability when storing heavy items due to the shape of bottom plate 216.

Figure 5:
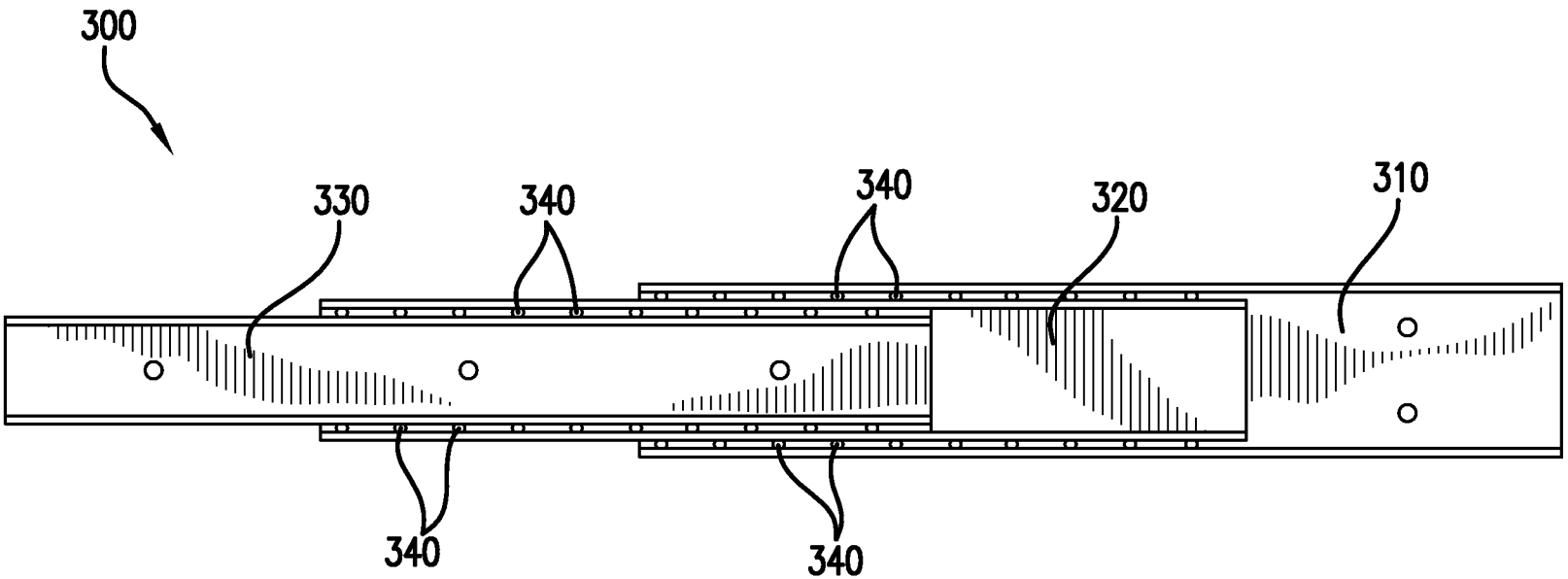
FIG. 5 illustrates a side view of an exemplary drawer slide as may be used in the refrigerator appliance of FIG. 1.

FIG. 5 illustrates side view of an exemplary drawer slide or set of slide rails 300. As an example, first, second, and third sets of slide rails 220, 230, and 250 (FIG. 3) may be constructed in a similar to drawer slide 300. Drawer slide 300 includes a first slide rail 310. First slide rail 310 may be fixed or mounted to cabinet 120, e.g., using fasteners. A second slide rail 320 is slidingly received within first slide rail 310 and can slide within first slide rail on bearings 340 disposed between first and second slide rails 310 and 320. A third slide rail 330 is slidingly received within second slide rail 320 and can slide within second slide rail on bearings 340 disposed between second and third slide rails 320 and 330. Third slide rail 330 may be fixed or mounted to freezer door 130. In such a configuration, the second and third slide rails 320 and 330 and in turn the freezer door 130 can slide relative to the first slide rail 310 such that freezer door 130 shifts open and closed as drawer slide 300 shifts between the extended and retracted positions.

As will be understood by those skilled in the art, drawer slide 300 in FIG. 5 is provided for example only. Thus, drawer slide 300 and first, second, and third sets of slide rails 220, 230, and 250 may have any other suitable construction. For example, drawer slide 300 may have only the first and second slide rails 310 and 320 or may include additional slide rails.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bottom-mount refrigerator appliance comprising:

a cabinet defining an upper fresh food chamber and a lower freezer chamber for receipt of food items, the lower freezer chamber comprising:

a top wall;

a bottom wall spaced apart from said top wall along a vertical direction; and a first side wall and a second side wall extending between said top and bottom walls along the vertical direction, said first and second side walls being spaced apart along a horizontal direction;

a basket received within the lower freezer chamber of said cabinet, said basket extending between a top portion and a bottom portion along the vertical direction, said basket having a bottom plate that is substantially arcuate along the horizontal direction;

a freezer drawer slidingly mounted within the lower freezer chamber and configured for permitting selective access to the lower freezer chamber of said cabinet, said drawer comprising:

a freezer door;

a first drawer slide and a second drawer slide mounting said freezer door to said cabinet and supporting said basket at the bottom portion of said basket, said first drawer slide secured to said first side wall at a bottom of the lower freezer chamber, said second drawer slide secured to said second side wall at the bottom of the lower freezer chamber, said first and second drawer slides each having a bracket with a flange of said basket positioned thereon in order to support said basket;

a third drawer slide disposed below said basket on the vertical direction and disposed between said first and second drawer slides on the horizontal direction; and a cross-member extending between and connecting said first, second, and third drawer slides, the cross-member disposed below said basket on the vertical direction.

2. The bottom-mount refrigerator appliance of claim 1, wherein said first and second drawer slides are disposed at or below a center of gravity of said basket on the vertical direction.

3. The bottom-mount refrigerator appliance of claim 1, wherein said connecting member is fixed to said first, second, and third drawer slides.

4. The bottom-mount refrigerator appliance of claim 1, wherein said basket is disposed on top of said cross-member.

5. The bottom-mount refrigerator appliance of claim 1, wherein said third drawer slide is disposed at a center of the lower freezer chamber on the horizontal direction.

6. The bottom-mount refrigerator appliance of claim 1, wherein said first and second drawer slides are vertically oriented and said third drawer slide is horizontally oriented.

7. The bottom-mount refrigerator appliance of claim 1, wherein said first, second, and third drawer slides are connected with said cross-member such that said first, second, and third drawer slides slide at the same rate along a transverse direction.

8. The bottom-mount refrigerator appliance of claim 1, wherein said basket is removably mounted within the lower freezer chamber.

9. The bottom-mount refrigerator appliance of claim 1, wherein said first and second drawer slides are positioned about equidistant from said third drawer slide.

10. The bottom-mount refrigerator appliance of claim 1, wherein said first drawer slide, said second drawer slide and said third drawer slide each comprise at least three slide rails slidably mounted to one another.

11. A refrigerator appliance comprising:

a cabinet defining a freezer chamber for receipt of food items;

a basket received within the freezer chamber of said cabinet, said basket extending between a top portion and a bottom portion along a vertical direction, said basket having a bottom plate that is substantially arcuate along a horizontal direction;

a drawer slidingly mounted within the freezer chamber and configured for permitting selective access to the freezer chamber of said cabinet, said drawer comprising:

a door;

a first drawer slide and a second drawer slide mounting said door to said cabinet and supporting said basket at the bottom portion of said basket, said first and second drawer slides secured to said cabinet at a bottom of the freezer chamber, said first drawer slide positioned on a first side of the freezer chamber, said second drawer slide positioned on a second side of the freezer chamber, said first and second drawer slides each having a bracket with a flange of said basket positioned thereon in order to support said basket;

a third drawer slide secured to said cabinet at the bottom of the freezer chamber, said third drawer slide also disposed below said basket on the vertical direction and disposed between said first and second drawer slides on the horizontal direction; and a cross-member extending between and connecting said first, second, and third drawer slides, the cross-member disposed below said basket on the vertical direction.

12. The refrigerator appliance of claim 11, wherein said first and second drawer slides are disposed at or below a center of gravity of said basket on the vertical direction.

13. The refrigerator appliance of claim 11, wherein said connecting member is fixed to said first, second, and third drawer slides.

14. The refrigerator appliance of claim 11, wherein said basket is disposed on top of said cross-member.

15. The refrigerator appliance of claim 11, wherein said third drawer slide is disposed at a center of the freezer chamber on the horizontal direction.

16. The refrigerator appliance of claim 11, wherein said first and second drawer slides are vertically oriented and said third drawer slide is horizontally oriented.

17. The refrigerator appliance of claim 11, wherein said first, second, and third drawer slides are connected with said cross-member such that said first, second, and third drawer slides slide at the same rate along a transverse direction.

18. The refrigerator appliance of claim 11, wherein said basket is removably mounted within the freezer chamber.

19. The refrigerator appliance of claim 11, wherein said first and second drawer slides are positioned about equidistant from said third drawer slide.

20. The refrigerator appliance of claim 11, wherein said first drawer slide, said second drawer slide and said third drawer slide each comprise at least three slide rails slidably mounted to one another.

* * * * *